US005971805A

United States Patent [19]

Belopolsky et al.

[11] Patent Number: 5,971,805

[45] Date of Patent: Oct. 26, 1999

[54] MODULAR JACK WITH FILTER INSERT

[75] Inventors: Yakov Belopolsky, Harrisburg; Robert E. Marshall, Elizabethtown; James A. Somerville, Hershey, all of Pa.; Gary J. Oleynick, Encinitas, Calif.; Lee W. Potteiger, Lewisberry; John M. Spickler, Columbia, both of Pa.; Ronald A. Shutter, Encinitas; Miguel A. Contreras, Chula Vista, both of Calif.

[73] Assignees: Berg Technology, Inc., Reno, Nev.; Pulse Engineering, Inc., San Diego, Calif.

[21] Appl. No.: 08/863,654

[22] Filed: May 27, 1997

[51] Int. Cl.[6] ..... H01R 13/66

[52] U.S. Cl. ..... 439/620; 439/941

[58] Field of Search ..... 439/620, 941, 439/676

[56] References Cited

U.S. PATENT DOCUMENTS

| | | | |
|---|---|---|---|
| 3,422,394 | 1/1969 | Antes | 439/637 |
| 4,109,986 | 8/1978 | Mouissie | 439/637 |
| 4,461,522 | 7/1984 | Bakermann et al. | 439/62 |
| 4,701,002 | 10/1987 | Mouissie | 439/426 |
| 4,726,638 | 2/1988 | Farrar et al. | 439/620 |
| 4,772,224 | 9/1988 | Talend | 439/607 |
| 5,015,204 | 5/1991 | Sakamoto et al. | 439/620 |
| 5,069,641 | 12/1991 | Sakamoto et al. | 439/620 |
| 5,239,748 | 8/1993 | Hamilton | 439/60 |
| 5,282,759 | 2/1994 | Sakamoto et al. | 439/620 |
| 5,399,107 | 3/1995 | Gentry et al. | 439/676 |
| 5,456,619 | 10/1995 | Belopolsky et al. | 439/620 |
| 5,587,884 | 12/1996 | Raman | 361/728 |
| 5,687,233 | 11/1997 | Loudermilk et al. | 439/620 |
| 5,766,043 | 6/1998 | Talend | 439/607 |

*Primary Examiner*—Neil Abrams
*Assistant Examiner*—T C Patel
*Attorney, Agent, or Firm*—Klarquist Sparkman Campbell Leigh & Whinston, LLP

[57] ABSTRACT

The present invention is a modular jack assembly which includes an outer insulative housing having top and bottom walls and opposed lateral walls while defining an interior section. This housing also has front and rear open ends. This assembly also includes an insulative insert having a top section, an upper side and a rear section having a base side and a recess. This jack is positioned so that the upper side of its top section is adjacent to top side of the insulative housing such that its terminal end extends into the interior section of the insulative housing and the rear section at least partially covers the rear open end of the insulative housing. This assembly also includes an electronic component mounted in the recess in the rear section of the insulative insert. A conductor is mounted in the electrical insert.

6 Claims, 9 Drawing Sheets

MODULAR JACK WITH FILTER INSERT

BACKGROUND OF THE INVENTION

1. Field of the Invention

The present invention relates to electrical connectors and more particularly, to electrical connectors in which noise filter means are incorporated.

2. Brief Description of Prior Developments

In electronic appliances containing modular jacks, various types of filters are used to reduce or eliminate noise. Such filters may include a three terminal capacitor or a common mode choke coil. A disadvantage in the use of such filters is that they may complicate the production of the circuit board. A need, therefore, has been perceived for providing a simple means of filtering noise in modular jacks.

The use of an integral ferrite element for this purpose is proposed in Japanese Patent Publication 64-2273. This reference discloses a modular jack having a modular insert installed in a casing. The body of the insert is formed with ferrite, and on one side of the insert body insert holes are formed for introducing connecting lines to be connected to respective contact springs.

While this reference would appear to simplify the apparatus used for noise filtering in modular jacks, a need for further increasing the compactness of such modular jacks with integral ferrite elements exists.

U.S. Pat. No. 5,456,619 discloses a filtered modular jack assembly having an outer insulative housing with open front and rear sides. A ferrite element with vertical conductive wires is positioned adjacent the rear end, and an elongated insulative insert is superimposed over the ferrite element. The insulative insert is fixed to the housing, and the conductive wire extends vertically from the ferrite element over the upper side of the insert to its terminal end and then bends downwardly and rearwardly to rest on the top surface of an interior medial wall in the housing. While this reference discloses an invention which increases compactness, a need still exists for a jack which can achieve such compactness while using alternate types of filtering elements which are not adapted to be mounted in the same way as the ferrite element.

SUMMARY OF THE INVENTION

The present invention is a modular jack assembly which includes an outer insulative housing having top and bottom walls and opposed lateral walls while defining an interior section. This housing also has front and rear open ends. This assembly also includes an insulative insert having a top section, an upper side and a rear section having a base side and a recess. The jack is positioned so that the upper side of its top section is adjacent to top side of the insulative housing such that its terminal end extends into the interior section of the insulative housing and the rear section at least partially covers the rear open end of the insulative housing. This assembly also includes an electronic component mounted in the recess in the rear section of the insulative insert. A conductor is mounted on the insulative insert. This modular jack provides a filtering element which is adapted to be easily and compactactly mounted in the jack.

BRIEF DESCRIPTION OF THE DRAWINGS

The filtered modular jack assembly of the present invention is further described with reference to the accompanying drawings in which.

DETAILED DESCRIPTION OF THE PREFERRED EMBODIMENTS

Figure 1:
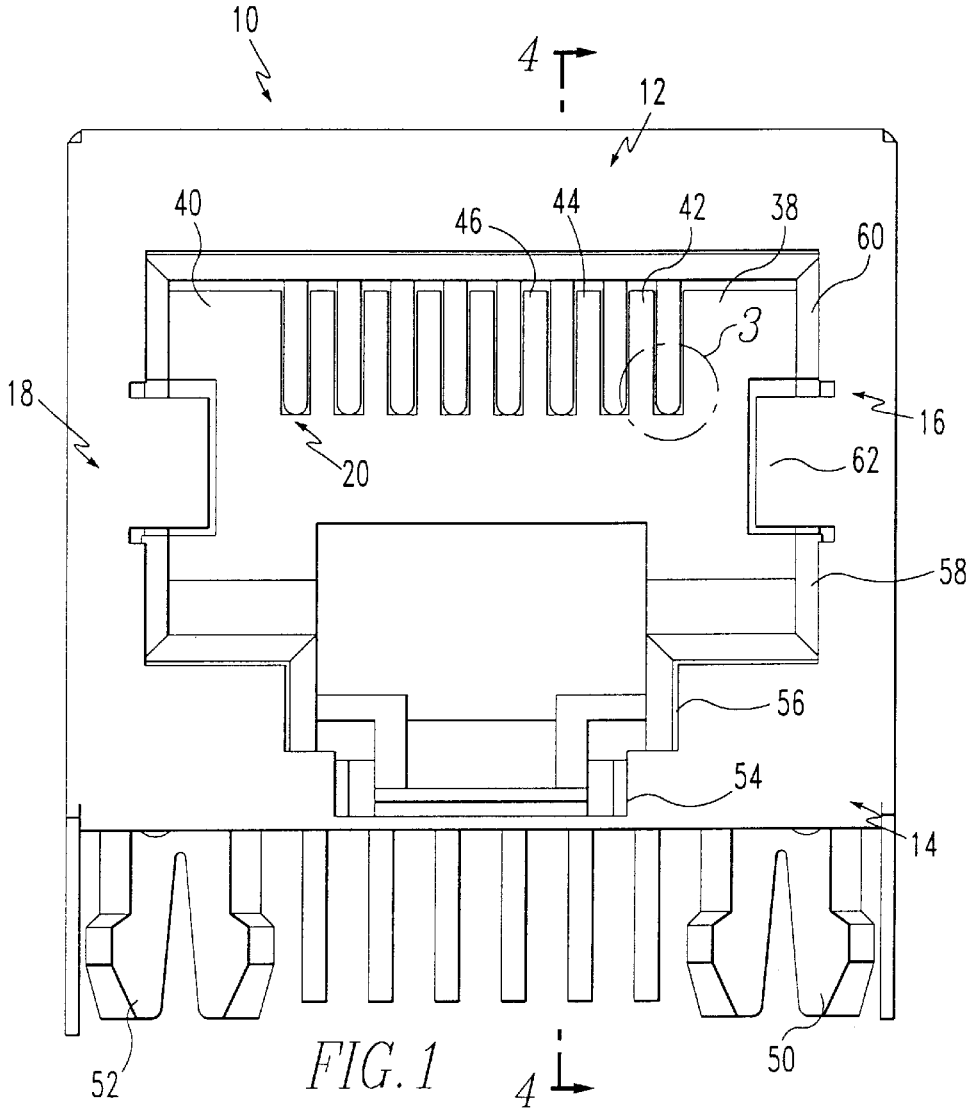
FIG. 1 is a front elevational view of a modular jack representing a preferred embodiment of the present invention.
Figure 3:
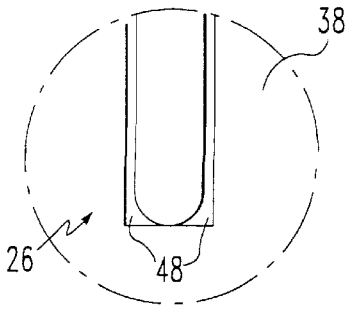
FIG. 3 is a detailed view of the area within circle 3 in FIG. 1.

Referring to FIGS. 1–10, the outer insulative housing is shown generally at numeral 10. This housing includes a top wall 12, a bottom wall 14 and a pair of opposed lateral walls 16 and 18. The housing is constructed of a thermoplastic polymer having suitable insulative properties and has conventional metallic exterior shielding. Within these walls is an interior section 20 which has a rear open end 22 and a forward open end 24. Projecting upwardly from the bottom wall in this interior section there is a medial wall generally shown at numeral 26 which has a rear side 28 and a front side shown generally at numeral 30 which includes a bottom front side 31, a top front side 32 and a recessed medial front side 34 and an inclined top side 36 which slopes upwardly and forwardly from its rear side toward its front side. Adjacent to the lateral walls, the medial wall has lateral extensions 38 and 40 which serve as projections to retain other elements as will be hereafter explained. Interposed between these lateral extensions there are a plurality of wire separation extensions as at 42, 44 and 46 and between these wire separation extensions there are plurality of slots as at 48.

As will be appreciated by those skilled in the art and is further explained hereafter, the wall and recesses of the outer insulative housing interact to receive an insert so as to make electrical connection between the conductors in the housing and the insert.

Extending downwardly from the bottom wall there are pins 50 and 52. The lateral wall 16 includes a lower shoulder 54, another shoulder 56, a lower main wall 58, an upper main wall 60 and a recessed wall 62 interposed between the lower and upper main wall. It will be seen that the lateral wall 18 has substantially identical features as lateral wall 16. The top wall 12 includes an upper bridge section 64, a lower bridge section 66, a front recess 68 and a rear recess 70.

Figure 4:
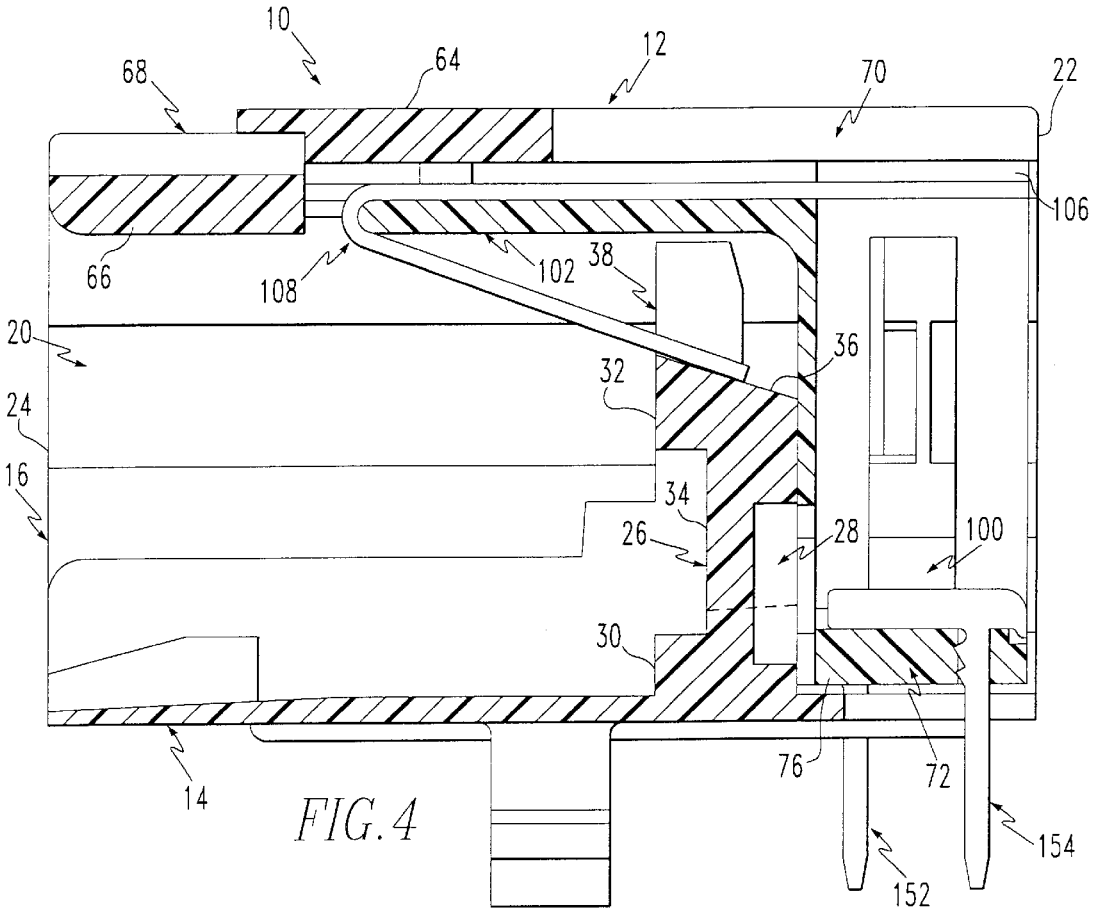
FIG. 4 is a cross sectional view through 4—4 in FIG. 1 in which for the purpose of showing other detail, shielding, the filter, and associated wires and the rear cap have been deleted.
Figure 5:
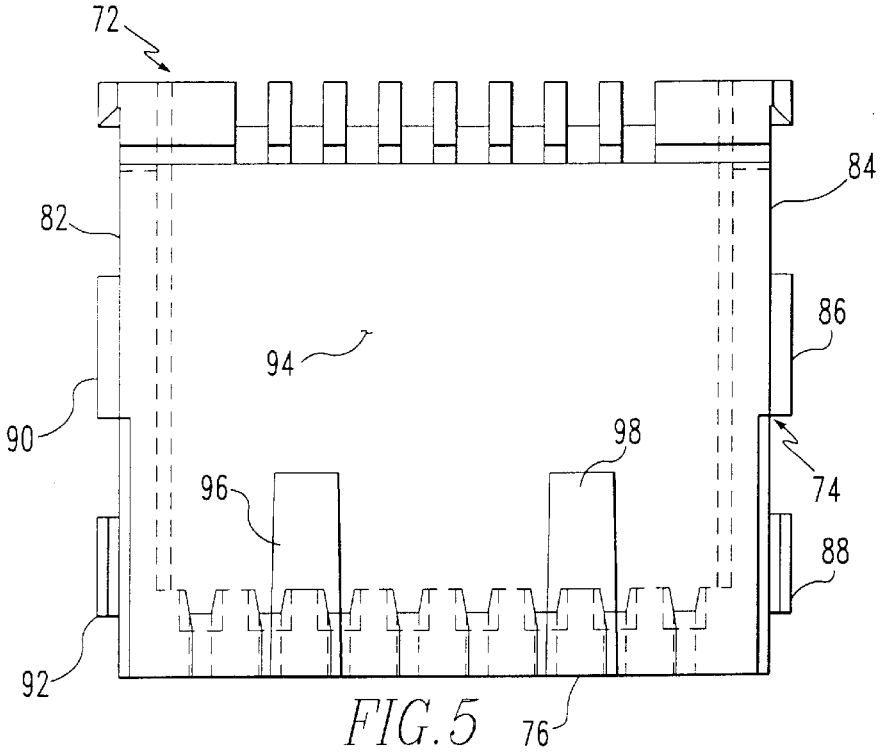
FIG. 5 is a front elevational view of the insulative insert used in the modular jack shown in FIG. 1.
Figure 7:
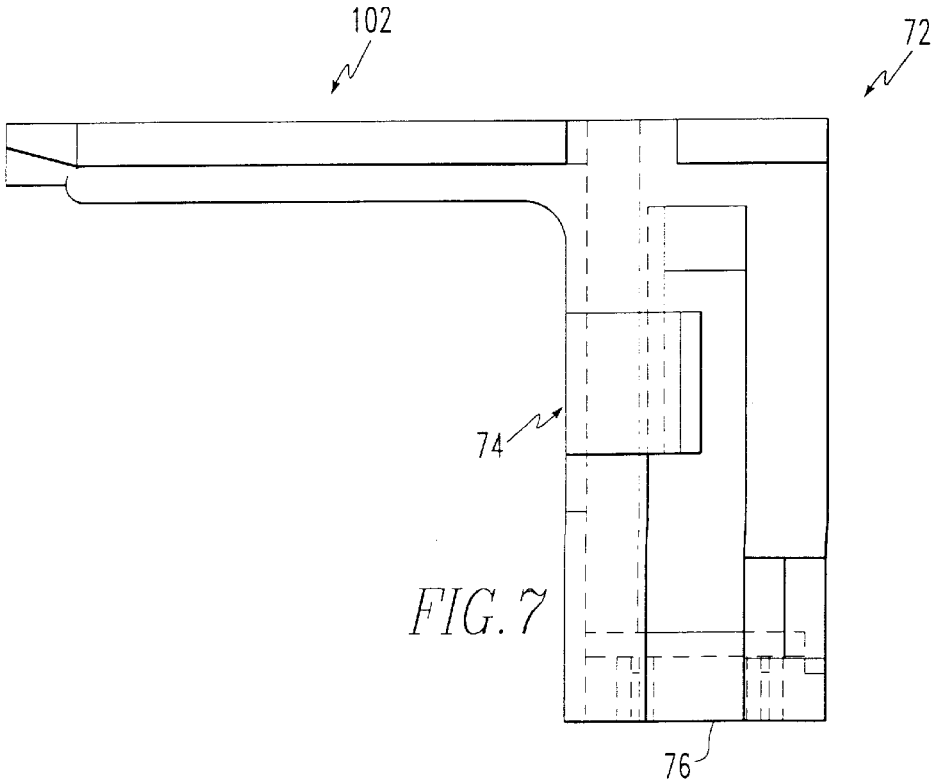
FIG. 7 is side elevational view of the insulative insert shown in FIG. 5.
Figure 8:
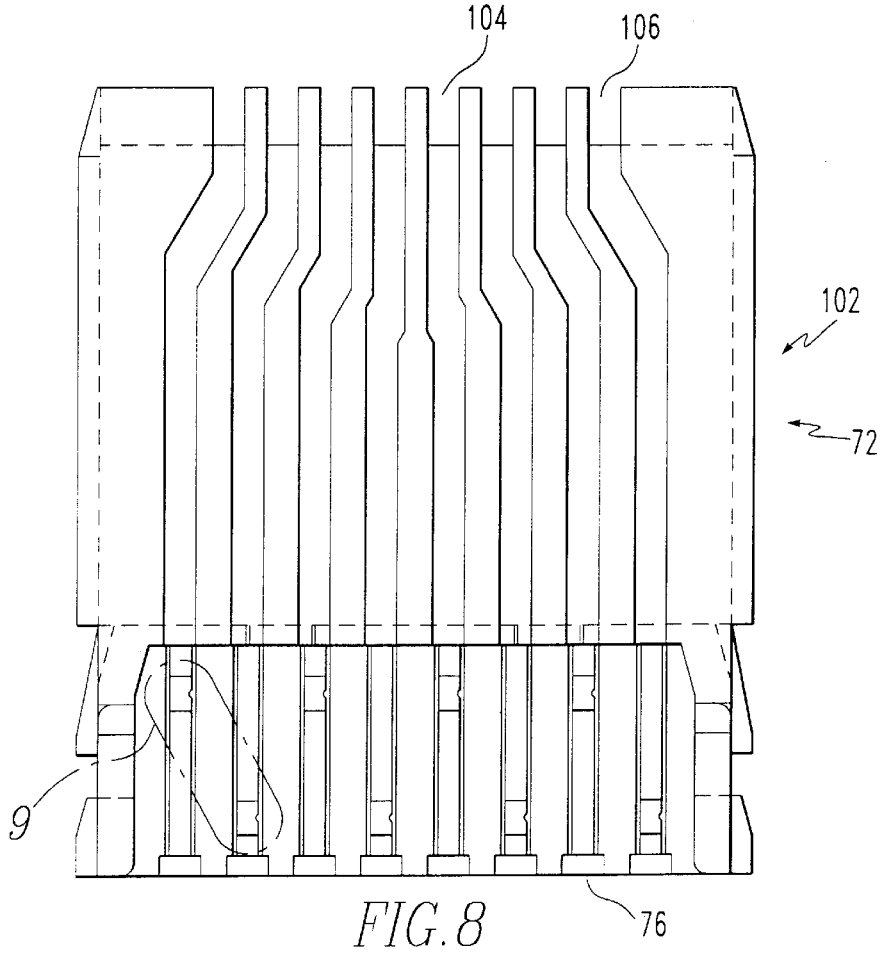
FIG. 8 is a top plan view of the insulative insert shown in FIG. 5.
Figure 6:
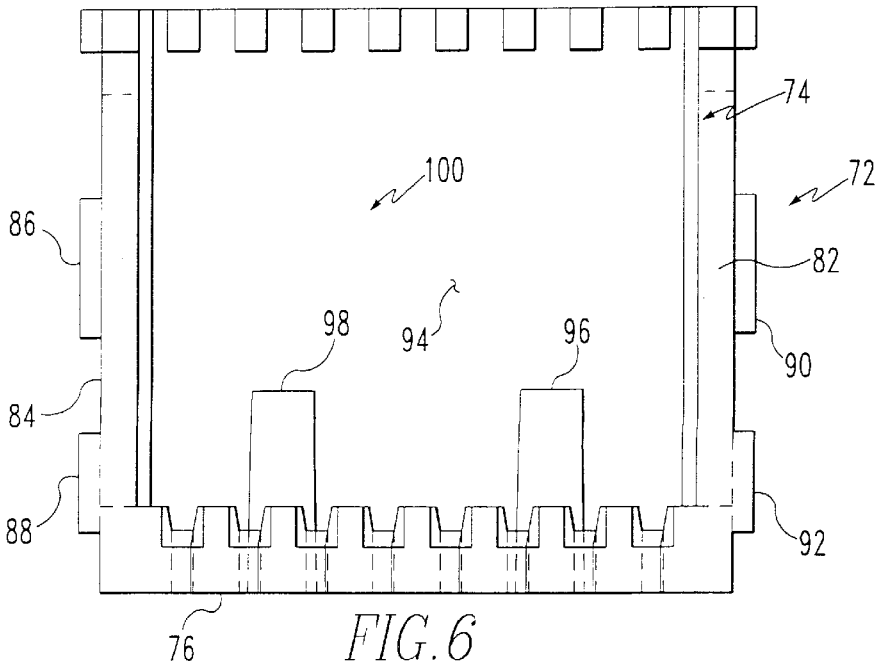
FIG. 6 is a rear elevational view of the insulative insert shown in FIG. 5.
Figure 9:
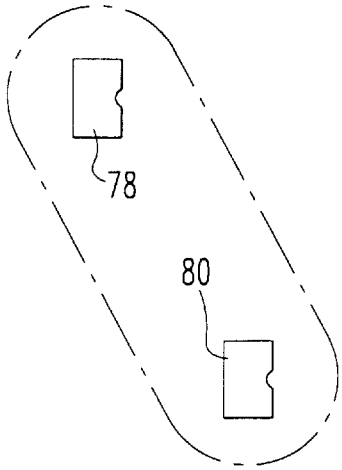
FIG. 9 is a detailed view of area 9 in FIG. 8.
Figure 10:
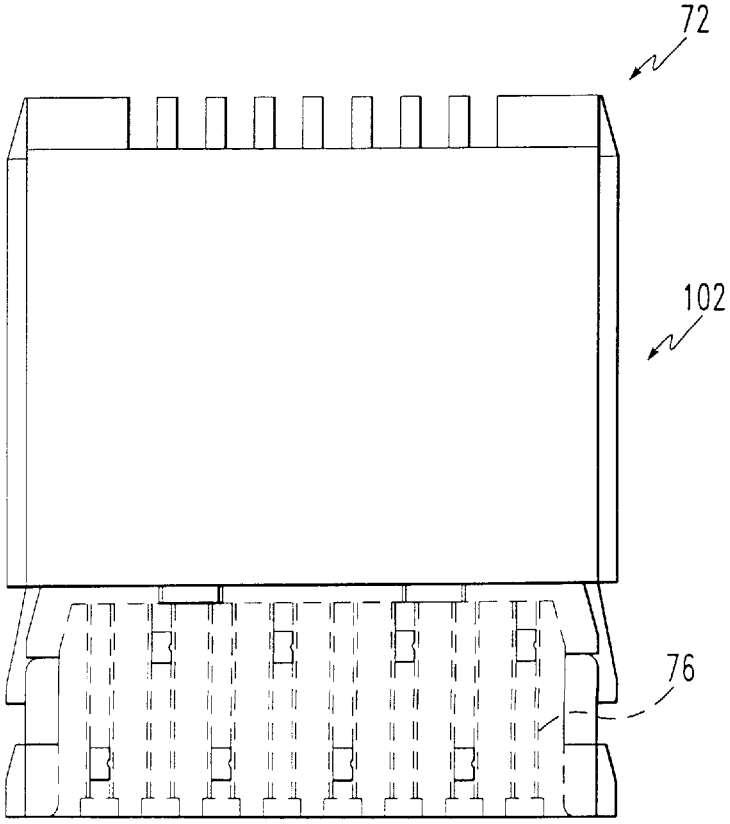
FIG. 10 is a bottom plan view of the insulative insert shown in FIG. 5.
Figure 12:
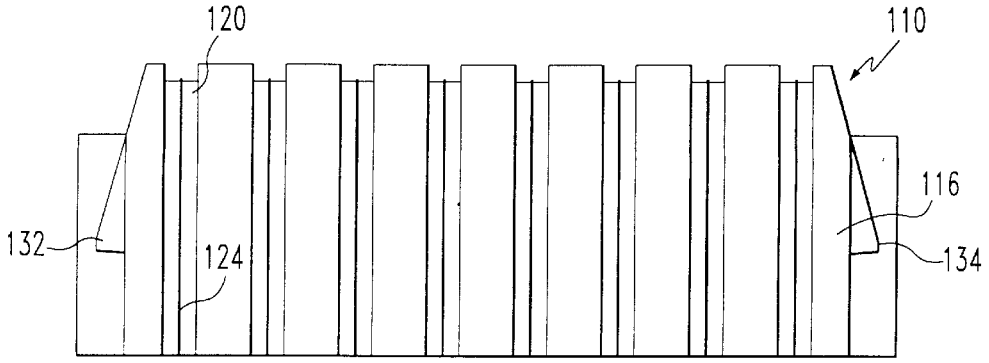
FIG. 12 is a top plan view of the cap shown in FIG. 11.
Figure 11:
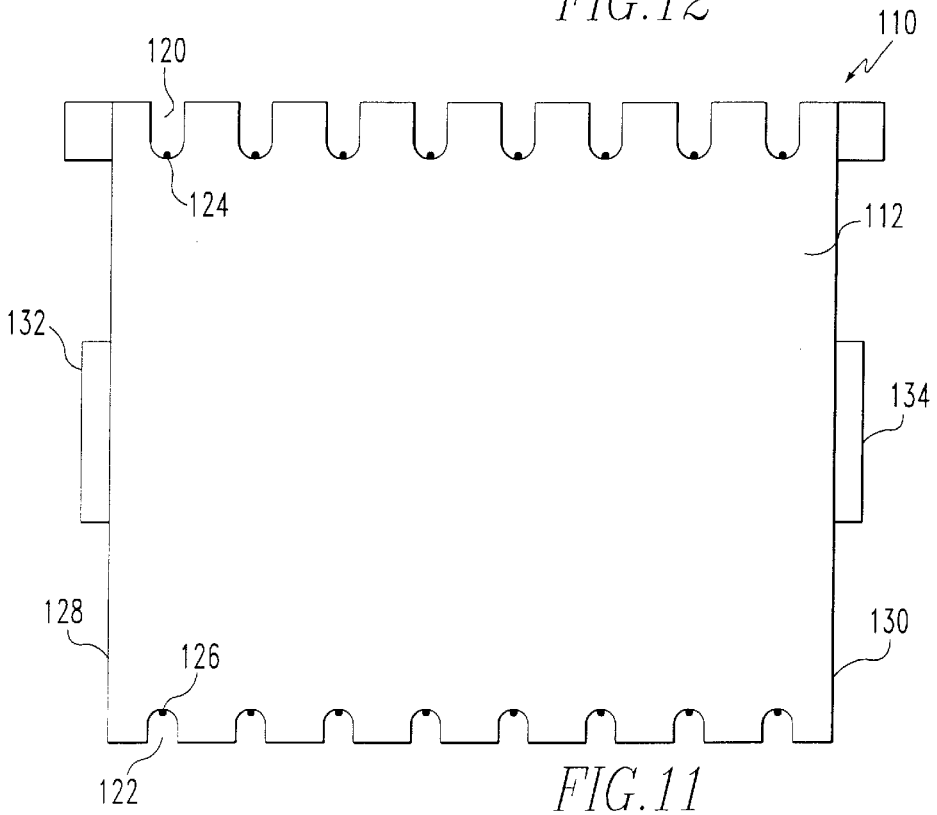
FIG. 11 is a rear end view of the cap element used in the modular jack shown in FIG. 1.
Figure 13:
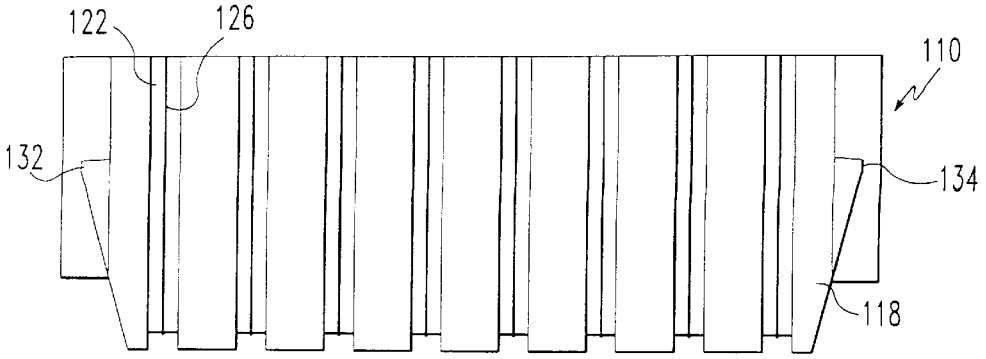
FIG. 13 is a bottom plan view of the cap shown in FIG. 11.
Figure 15:
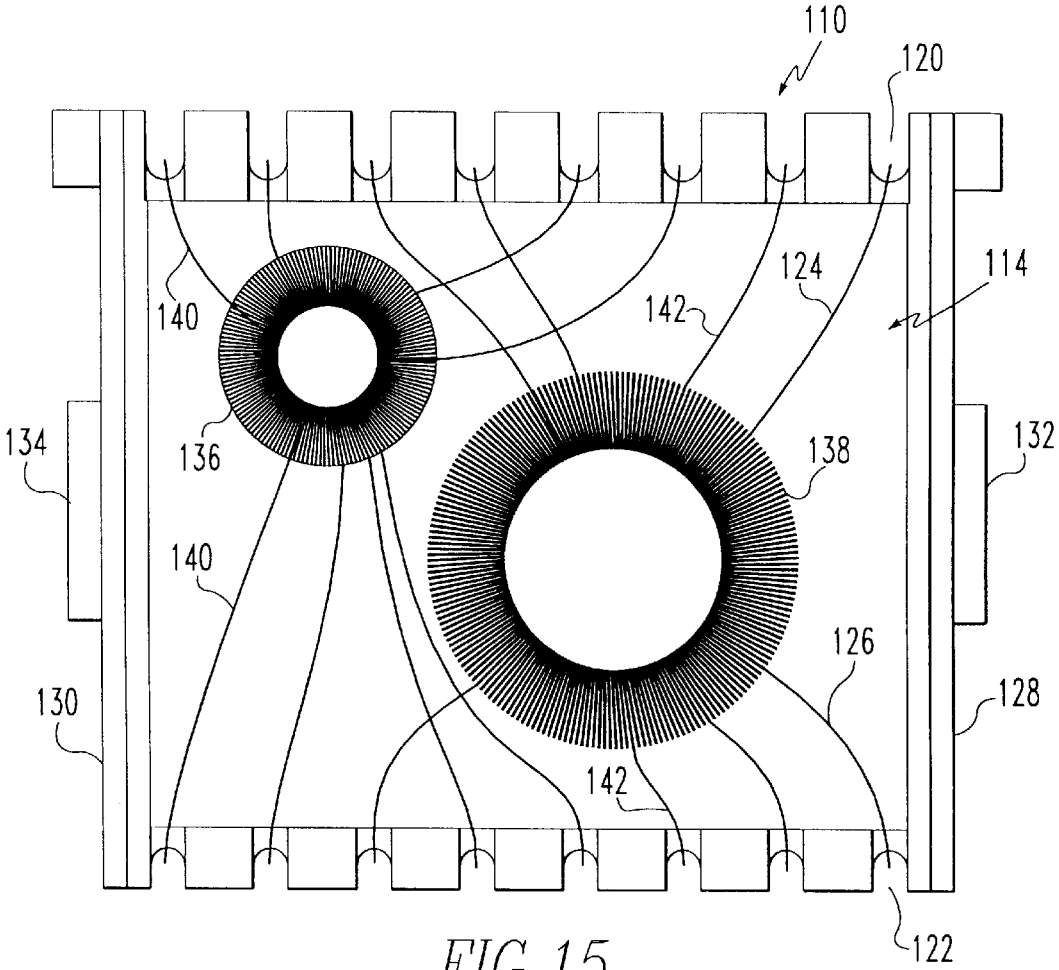
FIG. 15 is a interior view of the cap shown in FIG. 11.
Figure 14:
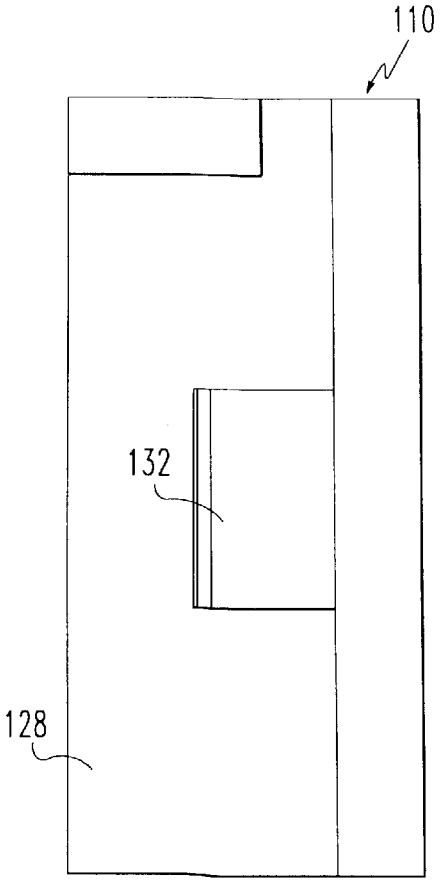
FIG. 14 is a side elevational view of the cap shown in FIG. 11.

Referring particularly to FIGS. 5–10, the insulative insert is shown generally at numeral 72. This insert has a vertical section shown generally at numeral 74 which includes a base wall 76. The base wall has a plurality of vertical bores as at 78 and 80. The vertical section also includes opposed side walls 82 and 84. Side wall 82 has a pair of latches 86 and 88. Side wall 84 has a pair of latches 90 and 92. The vertical section also has a front wall 94 in which there are apertures 96 and 98. Finally the vertical section 94 of the insert 92 has a recess 100. The insert also has a horizontal section shown generally at numeral 102 which has a plurality of grooves as at groove 104 and 106 which extend from the rear to the front of this horizontal section. In these grooves there are conductors as at wire 108 (FIG. 4).

Figure 2:
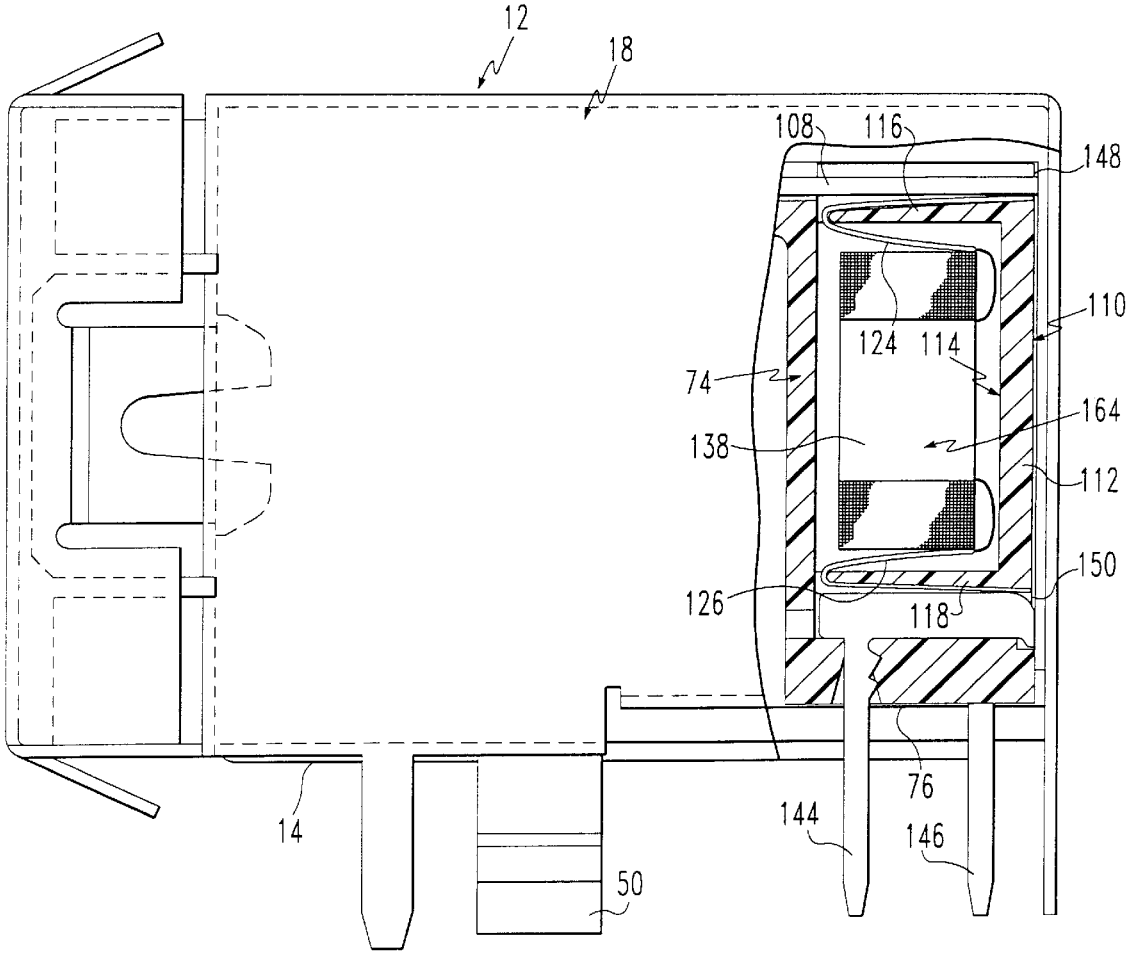
FIG. 2 is a cut away side elevational view of the modular jack shown in FIG. 1.

Referring particularly to FIG. 2 and 11–15, the cap element is shown generally at numeral 110. This cap element has a rear wall 112 and on the reverse side of this wall there is a recess 114. The cap also has a top end wall 116 and a bottom end wall 118 which have respectively grooves as at groove 120 and 122. Conductors as at wire 124 and 126 are positioned in each of these grooves. The cap also has side walls 128 and 130 which have respectively latches 132 and 134 for engaging the side walls 82 and 84 of the insulative insert. A filter means such as common mode chokes 136 and 138 are mounted on the inner or recess side of the wall 112. Other filtering elements known to those skilled in the art such as inductive serial filters, differential filters, low pass capacitive filters and other magnetic filters may be substituted for the common mode choke. Conductors as at wire 140 extend from the top wall to the common mode choke 136 and then to the bottom wall. Wires as at 142 extend from the top wall to the common mode choke 138 and then to the bottom wall. These wires are wound around the common mode chokes and serve to retain the common mode chokes in their positions. Referring particularly to FIG. 2, it will be appreciated that the wires that extend upwardly from the common mode chokes such as wire 124 are connected to the wires mounted in the insert such as wire 108. That is as wire 124 extends along the outside of wall it abuts wire 108. It will also be appreciated that the wires that extend downwardly from the common mode chokes such as wire 126 are connected to contacts such as contacts 144 and 146. That is, for example, as wire 126 extends along the outside of wire 118 it abuts contact 144. Another wire (not shown) abuts contact 146 in a similar way. At the ends of wires 124 and 126 there is an ultrasonic weld 148 and 150, respectively. Referring particularly to FIG. 4, it will be seen that contacts 152 and 154 are positioned to extend from the base wall 76 of the insert vertical section 74. To better show the recess 100 of the insert 22, the common mode chokes as at 136 and their connecting wires and the cap 110 are not shown. It will be understood, however, that wires from the common mode chokes are connected to the contacts 152 and 154 and to the insert wires as at wire 108 in the same way as is shown in FIG. 2.

Figure 16A:
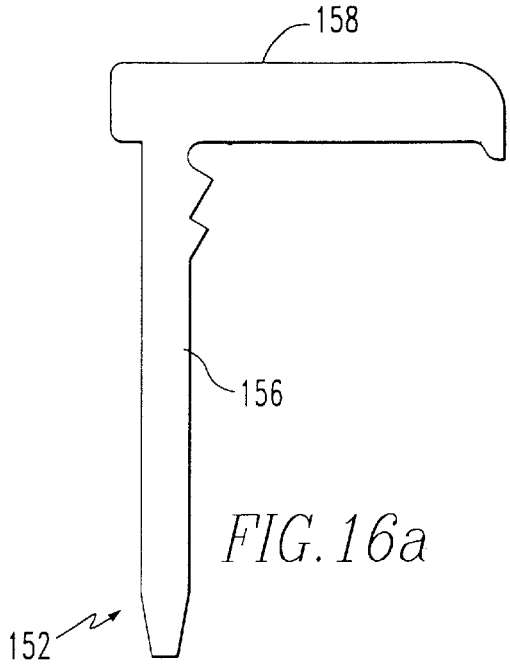
FIGS. 16*a* and 16*b* are side elevational views of two electrical contacts which are used in the modular jack shown in FIG. 1.
Figure 16B:
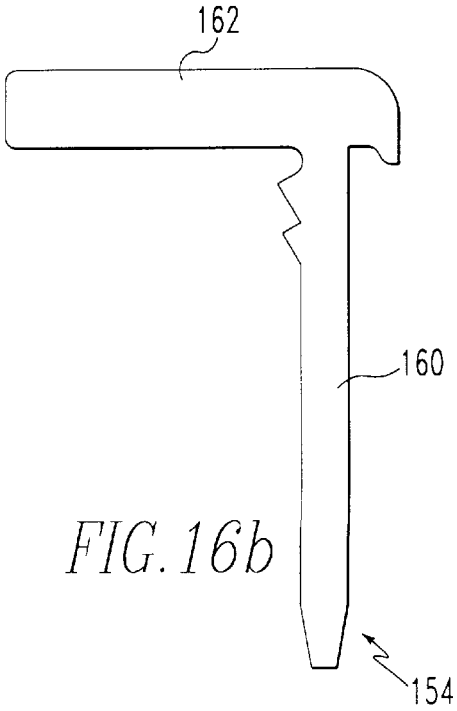

Referring particularly to FIG. 16*a*, it will be seen that contact 152 is comprised of a major vertical section 156 and a minor horizontal section 158. Referring particularly to FIG. 16*d*, it will be seen that contact 154 is comprised of a major vertical section 160 and a minor horizontal section 162 which is oriented in opposed relation to the horizontal section 158 of contact 152. Referring particularly to FIG. 2, it will be appreciated that the recess 100 and the cap element 110 together form an internal cavity 164 in the vertical section 74 of the insulative insert for containment of the common mode chokes.

It will be appreciated that a compact modular jack has been described which facilitates the use of several different types of filtering elements depending on specific needs. That is, a large variety of filters or other components may be housed in the recess of the insert. Consequently, the use of standard package as is required in many prior art modular jacks is not necessary so as to allow greater flexibility in meeting specific application needs.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular jack assembly, comprising:

an insulating housing having outer walls defining an interior section;

an insulative insert having a first recess therein, the insulative insert mounted within the interior section of the insulating housing;

a cap having a second recess therein, the cap mounted within the first recess of the insulative insert so that the first recess and second recess together form an internal cavity; and a filter mounted within the internal cavity formed between the insulative insert and the cap.

2. The modular jack of claim 1 wherein the insulative insert includes latches for securing the insulative insert within the insulating housing with a snap fit.

3. The modular jack of claim 1 wherein the cap includes latches for securing the cap within the insulative insert with a snap fit.

4. The modular jack of claim 1 wherein:

the insulative insert includes a first set of grooves formed therein; and the cap includes a second set of grooves formed therein;

the first set of grooves formed in the insulative insert aligning with the second set of grooves formed in the cap.

5. The modular jack of claim 4 further including:

a first set of conductors extending from the filter to the second set of grooves formed in the cap;

a second set of conductors extending within the first set of grooves in the insulative insert;

wherein the alignment of the first set of grooves with the second set of grooves allows the first and second sets of conductors to be aligned to facilitate connectivity between the first and second sets of conductors.

6. The modular jack of claim 4 further including a contact having a horizontal portion and a vertical portion, the horizontal portion fitting within one of the grooves within the cap and including a conductor within one of the grooves of the cap that is connected to the horizontal portion of the contact.

* * * * *